US005715923A

United States Patent [19]

Dekker et al.

[11] Patent Number: 5,715,923

[45] Date of Patent: Feb. 10, 1998

[54] CURRENCY ACCEPTOR WITH LOCKING CASH BOX

[75] Inventors: Donald A. Dekker, Grand Rapids; Lloyd D. Herring, Rockford; Robert I. Courts, Muskegon, all of Mich.

[73] Assignee: Rowe International, Inc., Grand Rapids, Mich.

[21] Appl. No.: 585,862

[22] Filed: Jan. 16, 1996

[51] Int. Cl.[6] ..... G07D 7/00

[52] U.S. Cl. ..... 194/206; 232/15

[58] Field of Search ..... 194/206, 207; 232/15, 16; 271/180, 181

[56] References Cited

U.S. PATENT DOCUMENTS

| | | | |
|---|---|---|---|
| 3,627,094 | 12/1971 | Kaufman . | |
| 3,655,186 | 4/1972 | Bayha . | |
| 3,841,550 | 10/1974 | Kaneda et al. | 232/15 |
| 3,843,043 | 10/1974 | Sciortino | 232/15 |
| 3,854,655 | 12/1974 | Amstrong . | |
| 3,917,260 | 11/1975 | Okkonen et al. . | |
| 3,948,376 | 4/1976 | Roman | 232/15 X |
| 4,011,931 | 3/1977 | Wyckoff . | |
| 4,045,017 | 8/1977 | Lundblad | 271/181 |
| 4,113,140 | 9/1978 | Graef et al. | 221/6 |
| 4,434,931 | 3/1984 | Hunt et al. | 232/15 |
| 4,540,081 | 9/1985 | Mori et al. . | |
| 4,678,072 | 7/1987 | Kobayashi et al. | 194/206 |
| 4,720,092 | 1/1988 | Juleff . | |
| 4,834,230 | 5/1989 | Kondo et al. | 194/206 |
| 4,887,808 | 12/1989 | Dekker et al. . | |
| 4,913,341 | 4/1990 | Bachman | 232/15 X |
| 4,949,901 | 8/1990 | Harris | 232/15 |
| 5,161,736 | 11/1992 | Roccoberton et al. . | |
| 5,205,481 | 4/1993 | Dekker . | |
| 5,411,249 | 5/1995 | Zouzoulas . | |
| 5,533,605 | 7/1996 | Mays et al. | 232/15 X |

FOREIGN PATENT DOCUMENTS

| | | |
|---|---|---|
| 238481 | 5/1962 | Australia . |
| 2453811 | 11/1980 | France . |
| 52-27700 | 3/1977 | Japan . |
| 59-12043 | 1/1984 | Japan . |

*Primary Examiner*—F. J. Bartuska

*Attorney, Agent, or Firm*—Van Dyke, Gardner, Linn & Burkhart, LLP

[57] ABSTRACT

A currency acceptor includes a currency acceptance and transport unit having a first housing and an actuatable latching assembly on the first housing. A cash box is provided having a second housing and an opening in the second housing configured to interface with the first housing in a manner that the actuatable latching assembly retains the housings together. In this manner, currency may be passed through the opening from the currency acceptance and transport unit to the cash box. A security cover is provided that is configured to engage the second housing over the opening. A locking mechanism is provided which includes a member which unlatches the latching assembly so that the cash box can be removed from the currency validation and transport assembly. The locking mechanism locks the security cover over the opening.

52 Claims, 5 Drawing Sheets

CURRENCY ACCEPTOR WITH LOCKING CASH BOX

BACKGROUND OF THE INVENTION

This invention relates generally to currency acceptors having a currency validation and transport unit and a cash box for accumulating currency accepted by the validator and deposited by the transport unit therein. More particularly, the invention relates to such currency acceptor having a lockable cash box which prevents access to the contents thereof when the box is removed from the currency validation and transport unit and prevents access to the contents when the box is attached to the transport unit.

Currency validation and transport units validate currency as authentic and transports the currency to a collection receptacle, or cash box. The bills are transported through an opening in the cash box and stacked on a plate which is spring biased in order to maintain a consistent stack which is pressed against flanges on opposite sides of the opening. When the cash box is removed from the currency validation and transport unit, the operator has access to the cash through the opening which creates a security risk.

In order to overcome the security risk, lockable cash boxes have been proposed, which require insertion of a plate between the opening in the cash box and the transport unit prior to allowing the cash box to be removed therefrom. The plate cannot be removed from the cash box opening without a key for a lock which also latches an access door in a closed position. Such lockable cash boxes have not been without their difficulties. One such difficulty is that insertion of the plate tends to contact the uppermost bill or bills in the stack, which tend to dome above the flanges as a result of the force exerted by the spring under the stacking plate. Such interference may result in a wadding of the currency, which is a nuisance and may foul up the operation of the unit.

It would furthermore be desirable to provide a lockable cash box which requires two keys in order to open the access door. One key may be carried by the operator of the boxes and the other key by a central counting facility. This would ensure that the operator is provided due credit for the cash removed from the units on that operator's route and ensures that the operator does not have individual access to the cash contents of the cash box.

It would further be desirable to provide a lockable cash box that is exceptionally rugged, in order to accommodate rough handling, and be exceptionally resistant to tampering. It would further be desirable to provide such rugged lockable cash box with a minimal number of components. The more components, the greater number of potential failure points in a mechanism. Furthermore, because there are typically many more cash boxes than there are currency validation and transport units, it is desirable to put as many as possible of the components in the currency validation and transport unit and as few as possible in the lockable cash box.

SUMMARY OF THE INVENTION

The present invention provides a currency acceptor unit having a lockable cash box that meets the above-specified requirements. A currency acceptor, according to the invention, includes a currency acceptance and transport unit having a first housing and an actuatable latching assembly on the first housing. A cash box is provided having a second housing and an opening in the second housing configured to interface with the first housing in a manner that the actuatable latching assembly retains the housings together, wherein currency may be passed through the opening from the currency acceptance and transport unit. A security cover is provided that is configured to engage the second housing over the opening. A locking mechanism is provided which includes a member which unlatches the latching assembly so that the cash box can be removed from the currency validation and transport assembly. The locking mechanism locks the security cover over the opening.

Because the actuatable latching assembly is a part of the currency acceptance and transport assembly, more of the mechanism is located therein rather than in the cash box. Furthermore, the member which unlatches the latching assembly must first pass through the security cover prior to unlatching the latching assembly. This requires that the security cover be fully positioned over the cash box opening prior to unlatching of the latching assembly without requiting that the manipulation of the cover per se operate the locking mechanism. In this manner, a locking mechanism is provided that is much more rugged and more difficult to defeat than known mechanisms.

A currency acceptor unit, according to another aspect of the invention, includes a currency acceptance and transport assembly having a first housing and a cash box having a second housing. An opening in the second housing is configured to interface with the first housing, wherein currency may be passed through the opening from the currency acceptance and transport unit. An actuatable latching assembly is provided on one of the housings and a pin engageable by the latching assembly is provided on the other of the housings in order to selectively retain the cash box to the currency acceptance and transport unit. A security cover is provided that is configured to engage the second housing over the opening. A locking mechanism is provided which unlatches the latching assembly so that the cash box can be removed from the currency validation and transport assembly. The locking mechanism includes a plunger that is reciprocable between a retracted position and an extended position in order to unlatch the latching assembly and to retain the security cover over the opening. A manual lever is provided for manual manipulation of the plunger.

Because this aspect of the invention provides a manually manipulated plunger which both unlatches the latching assembly, to separate the housings, and retains the security cover over the opening in the cash box, the mechanism is substantially more robust because the operation of inserting the security cover over the opening in the cash box does not per se operate all of the mechanism to both unlatch the latching assembly and lock the security cover in place.

According to yet another aspect of the invention, a currency acceptor unit is provided having a currency acceptance and transport assembly having a first housing and a cash box having a second housing and an opening in the second housing configured to interface with the first housing in a manner that currency may be passed through the opening from the currency acceptance and transport unit. A security cover is provided that is configured to engage the second housing over the opening. A currency displacement assembly extends substantially over the entire length of the opening in the second housing in the direction of movement of the security cover being engaged with the second housing. The displacement assembly is actuated by the security cover in a manner that substantially the entire surface of the stack of currency in the cash box is displaced away from the cover. In this manner, the entire stack of currency is a safe distance away from the leading edge of the cover so that wadding of the currency does not occur. In a preferred form, the currency displacement assembly includes a pair of moveable rails on opposite sides of the opening. The security cover in this embodiment includes a camming surface on opposite sides thereof. In this manner, movement of the security cover causes the camming surfaces to move the rails away from the cover progressively as the cover is inserted in order to move currency in the cash box from the path of movement of the cover.

The present invention further provides a lockable cash box which is capable of use with either one or two locks. In embodiments utilizing two locks, the locks perform additional functions besides controlling access to the contents of the cash box by requiring two keys to open the access door thereof. One of the keys must also be present in order to insert the security cover to remove the cash box from the currency validation and transport unit. This adds a security feature by preventing removal of a cash box by unauthorized personnel. Furthermore, the present invention prevents the security cover from being inserted if the locking mechanism is tampered with. Once the plunger is extended to unlatch the cash box, the plunger is blocked from retracting. The security cover, therefore, cannot be inserted over the opening in the cash box.

The present invention further provides a currency acceptor unit which is useable with lockable cash boxes which come in various capacities for bill accumulation. This is accomplished utilizing locking mechanism components which may be identical irrespective of cash box capacity. All of this may be accomplished in a manner which provides an exceptionally rugged lockable cash box with minimal cost and complexity in the cash box per se.

These and other objects, advantages, and features of this invention will become apparent upon review of the following specification in conjunction with the drawings.

DESCRIPTION OF THE PREFERRED EMBODIMENT

Figure 1:
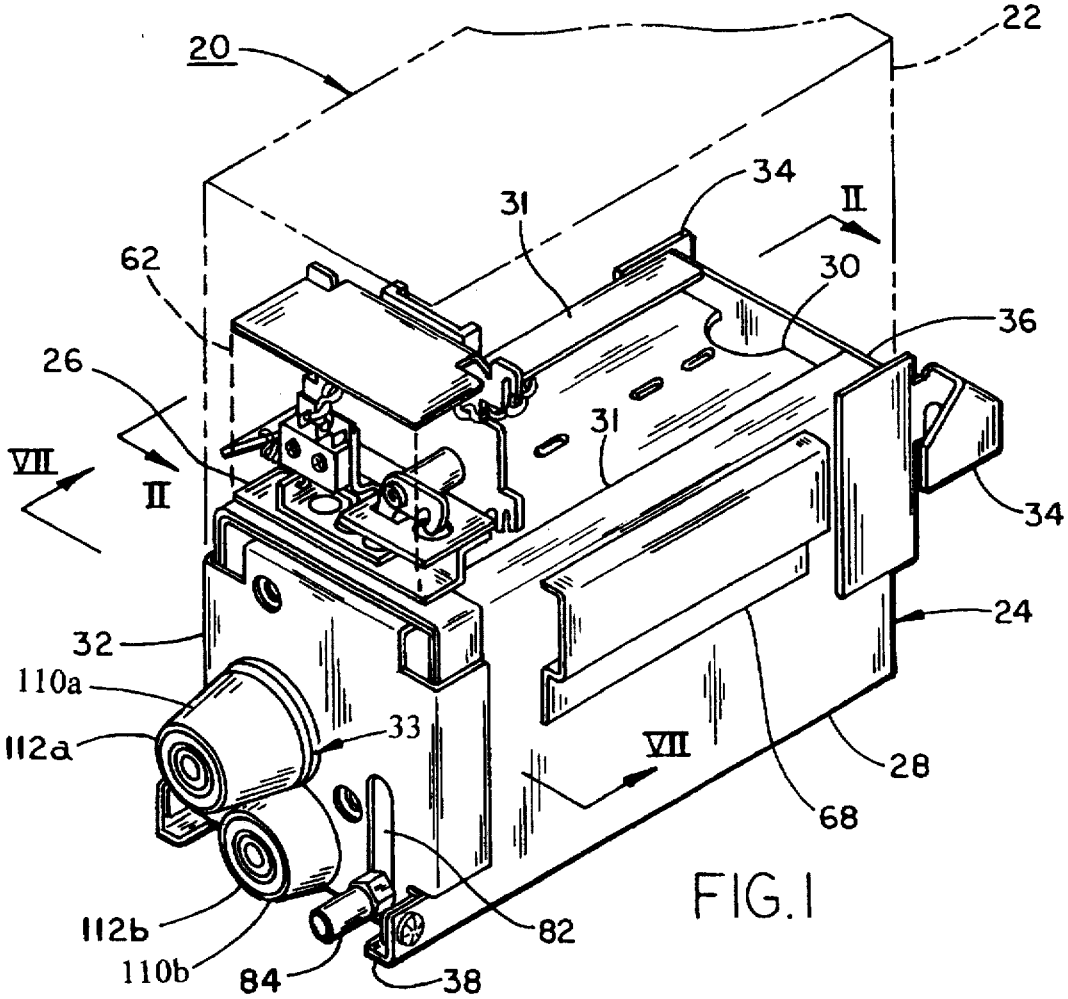
FIG. 1 is a perspective view of a currency acceptor unit according to the invention with portions removed to reveal internal components thereof.

Referring now specifically to the drawings and the illustrative embodiments depicted therein, a currency acceptor 20 includes a currency acceptance and transport unit shown generally in phantom at 22 and a lockable cash box 24 latched to the currency validation and transport unit (FIG. 1). Currency acceptance and transport unit 22 includes an actuatable latching assembly 26, but is otherwise a commercially available currency validation and transport unit marketed by Rowe International, Inc. of Grand Rapids, Mich. under Model Nos. CBA-2, UBA-2, CBA-4 and RBA-7. Lockable cash box 24 includes wall means defining a housing 28 having an opening 30 therein which is accessible to currency acceptance and transport unit 22 for insertion of currency into cash box 24. Cash retaining flanges 31 are provided on opposite sides of opening 30. Cash box 24 additionally includes a pair of hanging brackets 34, which provide pivotal attachment of an end 36 of cash box 24 to currency acceptance and transport unit 22. An opposite end 38 of cash box 24 is retained to currency acceptance and transport unit 22 by an actuatable latching assembly 26, which is within the housing of currency acceptance and transport unit 22, in a manner which will be described in more detail below. A lockable access cover 32 provides access to the interior 42 of housing 28 for removal of currency therefrom.

Figure 6:
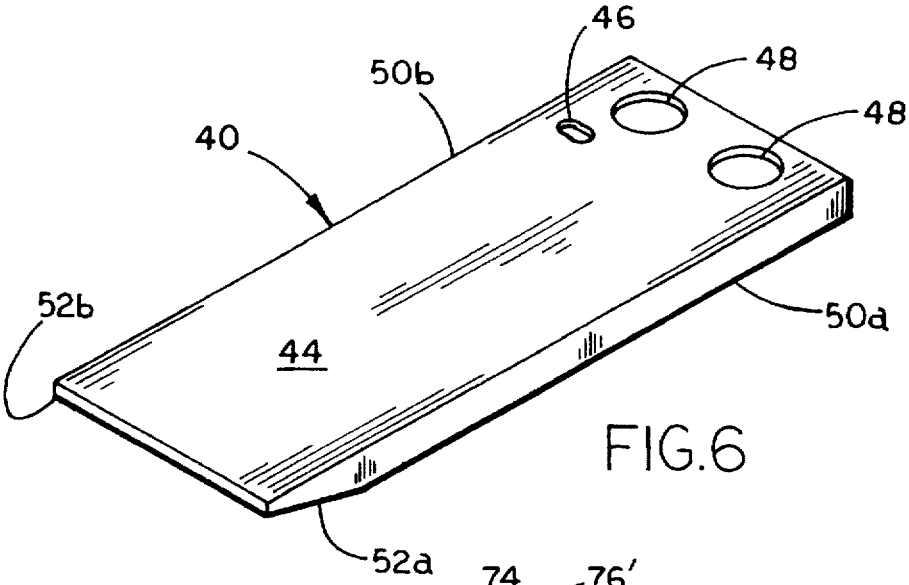
FIG. 6 is a top perspective view of a security cover.
Figure 14:
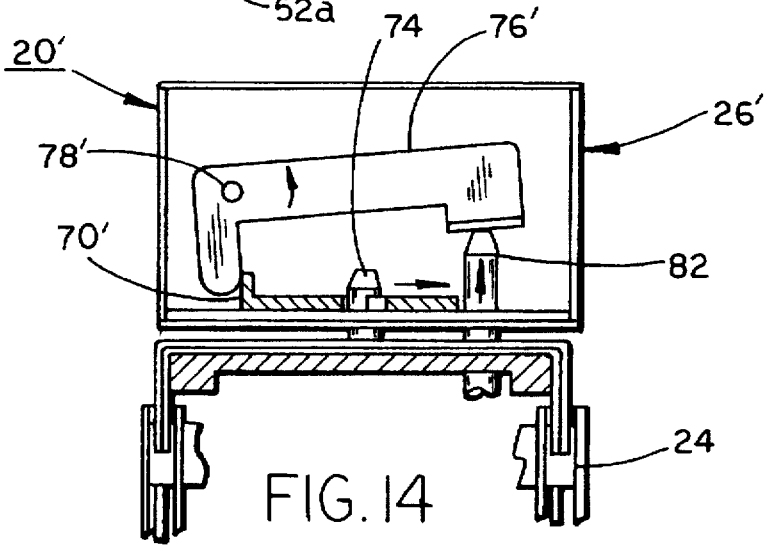
FIG. 14 is the same view as FIG. 7 illustrating an alternative embodiment of the invention.
Figures 7, 8, 9:
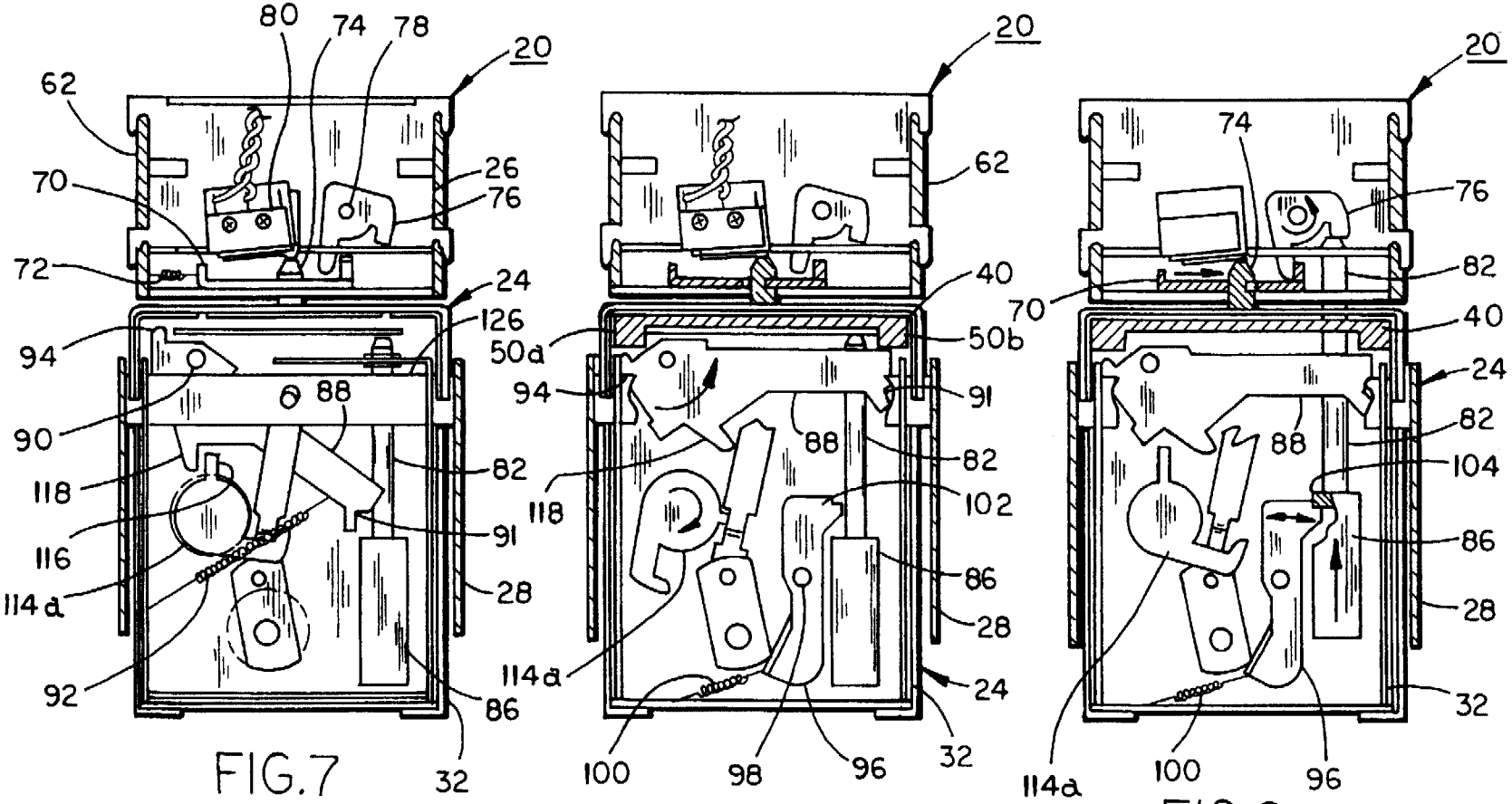
FIG. 7 is a sectional view taken along the lines VII—VII in FIG. 1 illustrating the cash box in a use position latched to the currency validation and transport unit.
FIG. 8 is the same view as FIG. 7 with a security cover inserted over the opening of the cash box.
FIG. 9 is the same view as FIG. 7 illustrating the plunger unlatching the cash box from the currency validation and transport unit.
Figure 10:
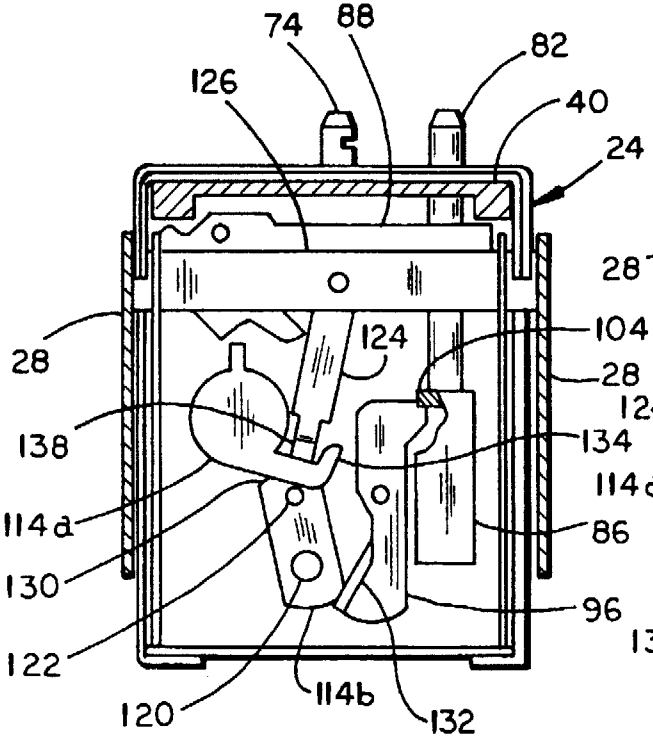
FIG. 10 is the same view as FIG. 7 illustrating a free-standing cash box locked in a secure configuration.

Currency acceptor 20 additionally includes a security cover 40 which is lockably retained over opening 30 in order to secure the contents of interior 42 of housing 28 of lockable cash box 24 in a manner which will be described in more detail below (FIG. 6). Security cover 40 includes a generally planar upper surface 44 having a through passage 46 formed therein in order to lock the security cover over opening 30 in a manner which will be described in more detail below. Upper surface 44 additionally includes a pair of finger holes 48 to assist in manipulation of the security cover with respect to the cash box. As best seen in FIGS. 8–10, security cover 40 additionally includes opposite lateral side extensions **50*a* and 50*b* which extend downwardly from the lateral sides of security cover 40. Side extensions 50*a* and 50*b* terminate at one end in sloping camming surfaces 52*a* and 52*b***.

Figure 2:
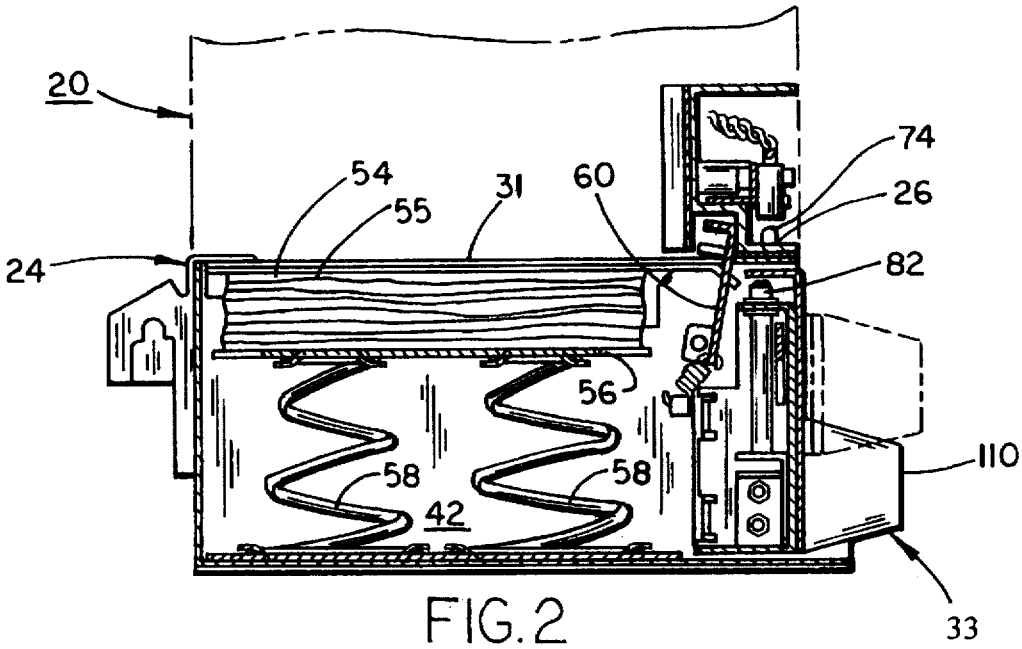
FIG. 2 is a sectional view taken along the lines II—II in FIG. 1.
Figure 3:
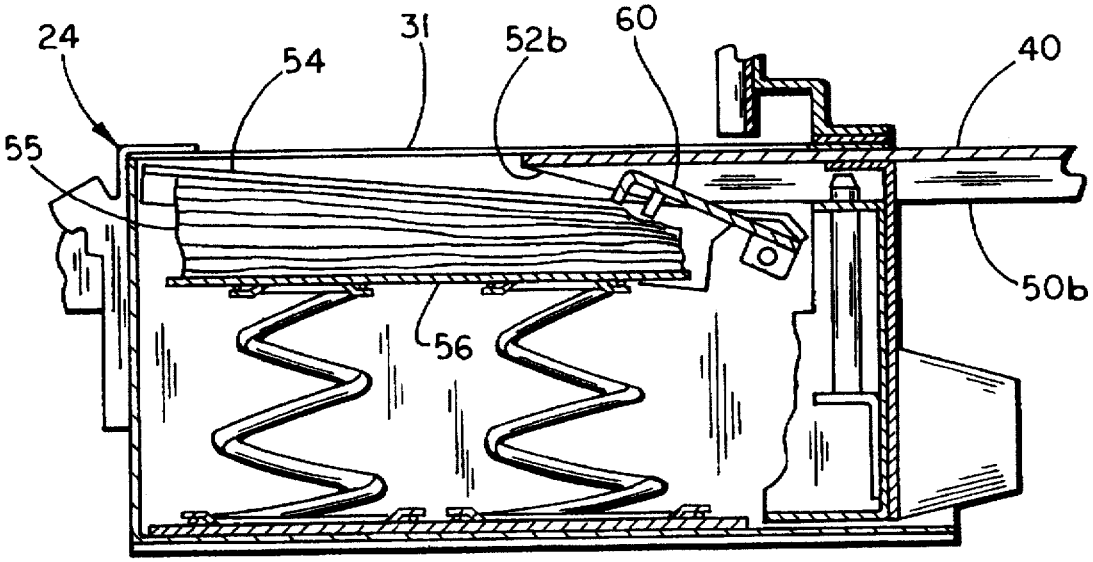
FIG. 3 is the same view as FIG. 2 illustrating a security cover in a partially inserted position over the cash box opening.
Figure 4:
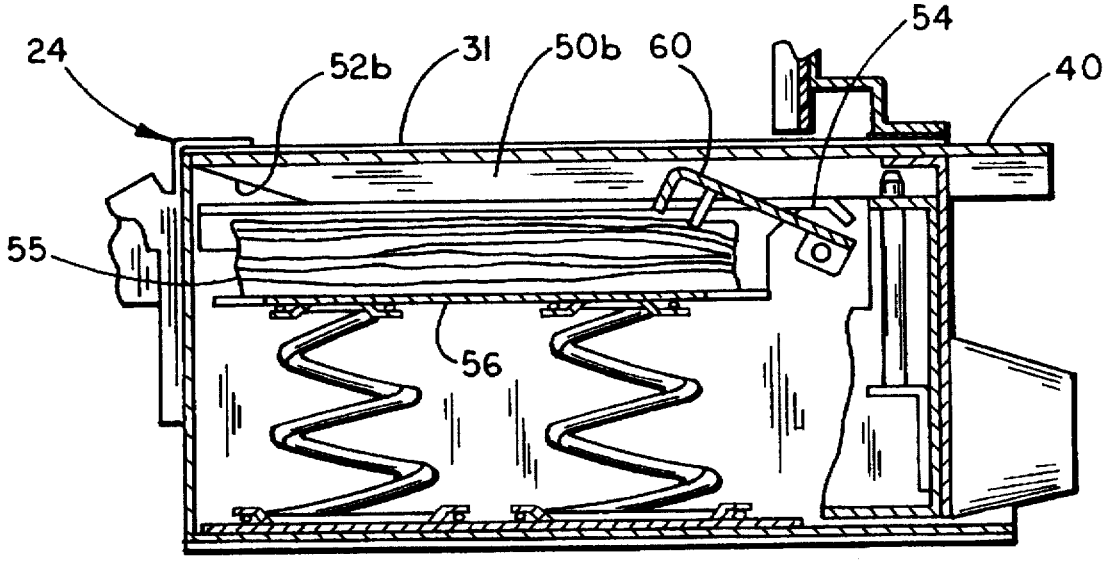
FIG. 4 is the same view as FIG. 3 with the security cover fully inserted.
Figure 5:
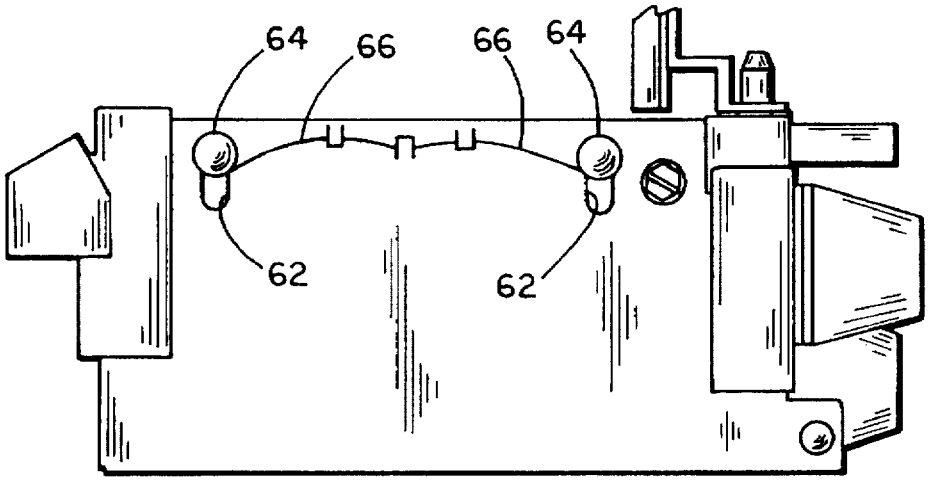
FIG. 5 is a side elevation of the currency acceptor in FIG. 1 with the side cover removed to reveal underlying components.

When security cover 40 is inserted over opening 30, as illustrated in FIGS. 2–4, camming surfaces **52*a*, 52*b* interact with a pair of side rails 54 which are below flanges 31 and extend over the lateral edges of a bill pusher plate 56. Pusher plate 56 is spring-biased upwardly toward moveable rails 54 by a biasing means 58 such as a pair of springs or a foam block, or the like. A conventional currency depressor 60 is mounted in the path of movement of security cover 40 at end 38 of cash box 24**.

Bills 55, which are deposited in cash box 24 from currency validation and transport unit 22, are stacked on bill pusher plate 56 against moveable rails 54 under the bias of springs 58. When the leading edge of security cover 40 is inserted under flanges 31 over opening 30, the leading edge of upper surface 44 contacts currency depressor 60 which causes the depressor to pivot counterclockwise, as viewed in FIGS. 2–4, which depresses the leading edge of the stack of bills at end 38 of the cash box out of the way of the movement of security cover 40. Concurrently therewith, camming surfaces **52*a*, 52*b* depress respective moveable rails 54. The depression of the moveable rails is progressive as the security cover is further inserted over opening 30 as best seen by comparing FIGS. 3 and 4. As the moveable rails are moved by side extensions 50***a*, 50*b* of the security cover 40, the stack of bills on pusher plate 56 are moved downwardly out of the way of upper surface 44 of security cover 40. In this manner, the entire surface of the uppermost bills in the stack are moved completely out of potential contact with upper surface 44 of the security cover so that no portion of the upper bills in the stack are contacted by the security cover.

Each moveable rail 54*a*, 54*b* is supported in a pair of slots 62 formed in a side of housing 28 by a pair of studs 64, which have heads that are larger than slots 62, extending outwardly from the respective rail 54. A wire spring 66 engages studs 64 and biases the respective moving rail 54 upwardly. A cover 68 protects stud 64 and spring 66 from damage during handling of lockable cash box 24.

Actuatable latching assembly 26 includes a laterally transversing retaining latch plate 70, which is biased toward the left, as viewed in FIGS. 7–9, by a spring 72. Latch plate 70 engages a latching pin 74 secured to housing 28 in order to retain the cash box latched with the currency validation and transport unit. Latch plate 70 is momentarily moved out of contact with pin 74, in order to unlatch the cash box, by a translation member 76 which is pivotally mounted at 78. A cash-box-present micro-switch 80 is actuated by pin 74 when cash box 24 is latched to currency validation and transport unit 24. Micro-switch 80 provides a signal to a logic circuit (not shown) in the currency validation and transport unit in order to avoid accepting currency without a cash box properly in place. A cover, or shroud, 62 prevents access to the components of latching assembly 26 in order to avoid tampering.

Translation member 76 is rotated in the direction of the arrow in FIG. 9 in order to unlatch the cash box from the currency validation and transport unit by a reciprocable plunger 82 positioned within access cover 32. A manual actuation lever 84, attached to a base 86 of plunger 82, extends through housing 28 in order to allow manual reciprocation of plunger 82 in order to rotate translation member 76 and thereby unlatch the cash box from the currency acceptance and transport unit (FIGS. 1 and 9).

Plunger 82 cannot be extended in order to unlatch actuatable latching assembly 26 unless a security cover 40 is properly inserted over opening 30 in a manner which will be described. A plunger keeper 88, which is pivoted at 90 and biased in a clockwise direction by a spring 92, has a notch 91 which intercepts base 86 of plunger 82 unless the plunger keeper 88 is rotated counterclockwise out of the path of movement of base 86. This counterclockwise rotation is effected by a protrusion 94 of keeper 88 which is positioned to be engaged by camming surface 52*a* and side extension 50*a*, as best seen by comparing FIGS. 7 and 8. With plunger keeper 88 rotated out of the path of movement of base 86 by security cover 40, as illustrated in FIG. 8, plunger 82 may be manually extended, as seen in FIG. 9. The extension of plunger 82 rotates translation member 76 and thereby move latching plate 70 away from engagement with latching pin 74 in order to allow separation of the cash box from the currency validation and transport unit. Plunger 82 travels through passage 46 in security cover 40. Therefore, security cover 40 must be fully inserted over opening 30 in order to allow plunger 82 to be fully extended to thereby unlatch latching assembly 26.

Once plunger 82 is fully extended, a plunger retraction blocking member 96, which is pivoted at 98 and biased in a clockwise direction by a spring 100 engages a flange 104 of plunger base 86 with a notch 102 in order to prevent retraction of the plunger, as best seen in FIG. 9. In this manner, once plunger 82 is extended in order to unlatch actuatable latching assembly 26 and thereby remove the cash box from the currency validation and transport unit, the plunger remains in an extended position which locks security cover 40 over opening 30.

Locking mechanism 33 in access cover 32 further includes one or more key lock devices 110. In the illustrated embodiment, lockable cash box 24 includes a first key lock device 110*a* and a second key lock device 110*b*. However, lockable cash box 24 may be provided with only one key lock device 110 as will be described in more detail below. First key lock device 110*a* includes a tumbler 112*a* on the outside of access cover 32 and a cam member 114*a* inside the access cover (FIG. 7). Cam member 114*a* has a first extension 116 which locks an extension 118 of plunger keeper 88 when key lock device 110*a* is in a locked position, as illustrated in FIG. 7. In this manner, in order to insert security cover 40 over opening 30 to remove cash box 24 from currency acceptance and transport unit 22, it is necessary for the operator to unlock key lock device 110*a*. When key lock device 110*a* is unlocked, cam member 114*a* is rotated clockwise to the position illustrated in FIG. 8. This removes extension 116 from the path of movement 118 and allows plunger keeper 88 to be rotated counterclockwise to the position illustrated in FIG. 8. If only one key lock device 110 is provided, then plunger keeper 88 is free to rotate upon insertion of security cover 40. In such embodiment with only one key lock device, the cash box can be removed by the insertion of the security cover 40 without first unlocking a key lock device. Thus, with two key lock devices, an additional security feature is provided because cash box 24 can be removed only by an individual possessing both a security cover and an operator key capable of unlocking key lock device 110*a*.

Figure 12:
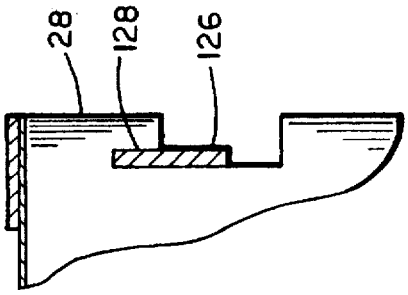
FIG. 12 is a side elevation of the access door latching bar in a latched position.
Figure 13:
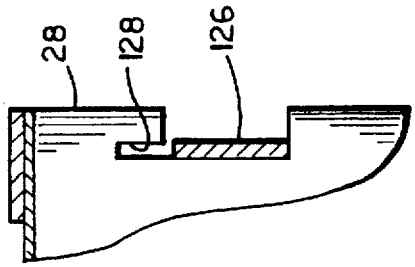
FIG. 13 is the same view as FIG. 12 of the security bar in an unlatched position.
Figure 11:
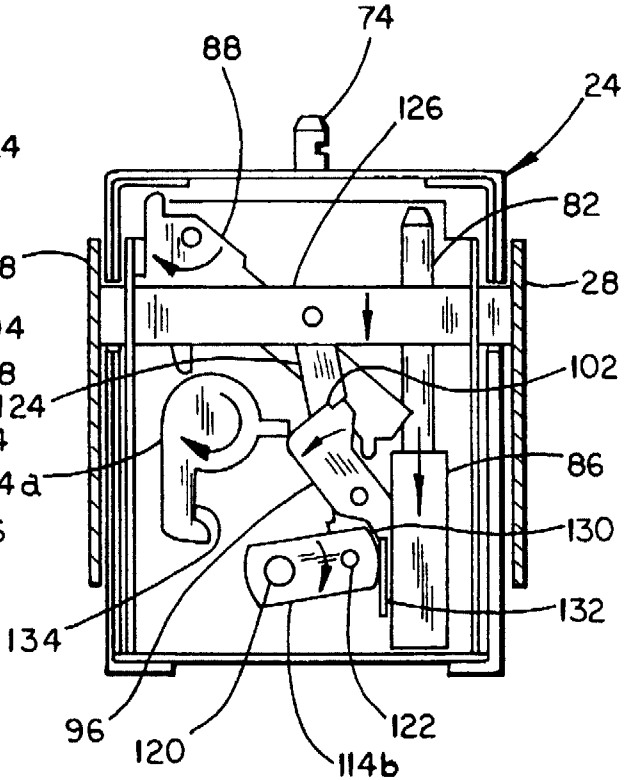
FIG. 11 is the same view as FIG. 7 illustrating opening of the access cover of the locked cash box.

Second key lock device 110*b* includes a tumbler 112*b* on the outer surface of access cover 32 and a cam member 114*b* within access cover 32. Cam member 114*b* pivots at 120 and is connected at 122 to a connecting rod 124 connected with a latching bar 126. As best illustrated by reference to FIGS. 12 and 13, latching bar 126 engages a pair of slots 128 in housing 28 when the latching bar is in the upper position as illustrated in FIG. 12. When the latching bar is moved to a lower position, as illustrated in FIGS. 11 and 13, the latching bar is free of slots 128 and access cover 32 may be pivoted downwardly in order to gain access to the interior 42 of cash box 24 to empty the contents thereof. Each end of latch bar 126 engages a slot 128 in housing 28 and thereby securely latches opposite sides of access cover 32 in position preventing access to interior 42 of cash box 24.

Cam member 114*b* of second key lock device 110*b* includes a camming surface 130 which engages a flange 132 of plunger blocking member 96. Camming surface 130 moves flange 132 to the right, as viewed in FIGS. 10 and 11, which rotates blocking member 96 counterclockwise and thereby releases flange 104 from notch 102. This allows plunger 82 to be retracted from an extended to a retracted position, as illustrated in FIG. 11. Therefore, upon unlocking of key lock device 110*b*, cam member 114*b* rotates clockwise from the position illustrated in FIG. 10 to the position illustrated in FIG. 11 which rotates blocking member 96 in a clockwise direction which releases plunger 82 and allows the plunger to be retracted. With the plunger retracted by manual operation of lever 84, security cover 40 can then be removed from opening 30, as seen by comparing FIGS. 10 and 11. Additionally, the rotation of cam member 114b, as a result of the unlocking of key lock device 110b, pulls connecting rod 124 downwardly under the movement of connection 122 which slides latching bar 126 from the latched position, illustrated in FIGS. 10 and 12, to the unlatched position, illustrated in FIGS. 11 and 13. Therefore, the operation of key lock device 110b additionally unlatches access cover 32 which allows access to interior 42 of the cash box to empty the contents thereof.

Cam member 114a of key lock device 110a includes a hook member 134 which engages an extension 138 of connecting rod 124 when first key lock device 110a is in a locked position, as illustrated in FIG. 10. In this manner, second key lock device 110b cannot be unlocked when first key lock device 110a is in a locked position because hook member 134 prevents downward travel of connecting rod 124 under the rotation of cam member 114b of second key lock device 110b. Therefore, in order to open access cover 132 of a two-lock cash box, it is first necessary to first unlock key lock device 110a and thereby rotate cam member 114a from the position illustrated in FIG. 10 to the position illustrated in FIG. 11. Once the first key lock is unlocked, the second key lock device 110b may be rotated because there is no longer any interference by hook 134 with extension 136.

It can thus be seen that two keys are required in order to unlock access cover 32 in order to gain the contents of interior 42 of lockable cash box 24. The first key unlocks first key lock device 110a which allows second key lock device 110b to be unlocked. However, a second key is required to unlock the second key lock device. Unlocking of the second key lock device, in turn, unlatches the latching bar which allows the access cover to open. It additionally removes blocking member 96 from engagement with plunger 82 and thereby allows plunger 82 to be retracted. This allows security cover 40 to be removed. Once the contents of the cash box are removed, the access cover is relatched. This places lockable cash box 24 in a state ready to be placed back into service by engaging currency acceptance and transport unit 22.

It can thus be seen that the key for first key lock device 110a may be provided to the operator who accesses the currency acceptor in order to remove the lockable cash box therefrom. This key allows the first key lock device to be unlocked, as seen by comparing FIGS. 7 and 8, in order to allow insertion of the security cover over opening 30 and thereby allow removal of the cash box from the currency validation and transport unit. This same key is also required in order to unlatch the access cover in order to gain access to the interior of the cash box to remove the contents thereof. However, a second key, for unlocking second key lock device 110b, is also required in order to open access cover 32 and empty the contents of the cash box. Thus, both the operator and a central counting authority must be present in order to access the contents of the cash box. This provides accountability to the operator because the operator is ensured that the contents of cash boxes assigned to that operator will be properly credited to that operator. However, the operator is not allowed access to the cash box except at the appropriate cash removal facility.

In an alternative embodiment, a currency acceptor 20' includes an actuatable latching assembly 26' having a slide plate 70', which is actuated by a translation member 76' that is pivoted at 78', by extension of plunger 82. The rotation of translation member 76' about pivot 78' moves a latching plate 70' away from contact with latching pin 74 which allows the cash box 24 to be moved from the currency validation and transport unit. This is a less preferred embodiment. Adjustable latching assembly 26 is preferred because the smaller lever arm of translation member 76 reduces the ability to tamper with the latching assembly. This smaller lever arm makes it more difficult to trick the latching assembly with a tool or the like.

In the illustrated embodiment, key lock devices 110 are commercially available lock sets which are marketed by National Cabinet Lock under the "KeSet" trademark. Such lock sets are preferred because they may be set to one of 64 keys externally of the access cover 32. This allows the lock set to be assembled in a neutral position with the remaining components of locking mechanism 34 and subsequently keyed to a particular key external of access cover 32 utilizing capabilities provided in the KeSet lock set. However, other lock sets may be utilized including those which are set during production. In the illustrated embodiment, the components of lockable cash box 24 are manufactured substantially from zinc-plated steel. In the illustrated embodiment, security cover 40 is manufactured from extruded aluminum. However, security cover 40, as well as many of the components of lockable cash box 24, could be manufactured from molded metal or plastic utilizing techniques well known in the art.

Because the present invention moves the entire stack of bills away from the security cover, not just the leading edge of the bills, interference between the sliding security cover and the stack of bills is substantially eliminated. This greatly reduces the likelihood of fowling, or snagging, of the bill stack by insertion of the security cover. The present invention provides an exceptionally robust and rugged currency acceptor in which the actuatable latching assembly is a part of the currency acceptance and transport unit and interfaces with a stationary latching pin on the cash box. This reduces the complexity and, therefore, the cost and likelihood of malfunctioning in the cash box. Furthermore, the positioning of the actuatable latching assembly in the currency acceptance and transport unit requires that the plunger extend through the security cover prior to unlatching the cash box. This improves the ruggedness of the assembly because it is the location of the opening through which the plunger passes in the security cover which establishes that the security cover is fully inserted over the opening in the cash box prior to removal of the cash box. Therefore, no appendages to the security cover are required to initiate the unlatching action. Furthermore, if an attempt is made to defeat the mechanism by utilizing a tool, or the like, to rotate the plunger keeper out of contact with the plunger to unlatch the latching assembly without a security cover in place, the security cover cannot be subsequently applied in order to hide the fact that elicit access has been gained to the cash box. This is because the plunger is retained in its extended position and the security cover cannot be subsequently added. Furthermore, the use of a manual lever to extend the plunger and unlatch the latching assembly makes the assembly more rugged because springs and the like are not required in order to carry out the unlatching operation. Furthermore, the latching bar, which engages the housing of the cash box on opposite sides of the access cover, provides exceptionally tamper-resistant latching of the access cover.

The components of the locking mechanism in the access cover may be made identical irrespective of the size of the access cover. In this manner, precisely the same components can be utilized in the locking mechanism for cash boxes of varying capacities; namely, 500 bills, 1,000 bills, 2,000 bills, and the like.

The security cover can be optionally attached to the bill box by means of a steel cable to keep it with the cash box.

The cover can be attached to the cable permanently, such as with rivets, or it can be attached with screws so that the cable can be removed if desired by the operator.

The security plate can be stored on the back of the cash box by optional brackets attached to the back of the cash box. These brackets can be attached permanently, such as with welds or rivets, or removably secured with screws and nuts so that they can be removed if desired. One reason why removal may be desired is to reduce the overall length of each box in some applications where there may not be room for the brackets. The security cover may alternatively be stored on the top of the access cover held in place by brackets.

Although the invention has been illustrated as applied to a currency acceptor unit having a currency validation assembly, it may be applicable to other currency acceptor units including those, such as safe storage units and the like, which do not validate the currency. Although the invention is illustrated with a security cover that is a separate, or separable, member from the cash box, it may alternatively be embodied in a unit in which the security cover is a pennanent component of the cash box.

Changes and modifications in the specifically described embodiments can be carried out without departing from the principles of the invention which is intended to be limited only by the scope of the appended claims, as interpreted according to the principles of patent law including the doctrine of equivalents.

The embodiments of the invention in which an exclusive property or privilege is claimed are defined as follows:

1. A currency acceptor unit, comprising:

a currency acceptance and transport assembly having a first housing and an actuatable latching assembly on said first housing;

a cash box having a second housing and an opening in said second housing configured to interface with said first housing in a manner that said actuatable latching assembly retains said housings together, wherein currency may be passed through said opening from said currency acceptance and transport unit;

a security cover configured to engage said second housing over said opening; and a locking mechanism including a member which unlatches said latching assembly so that said cash box can be removed from said currency acceptance and transport assembly, wherein said locking mechanism and said latching assembly are on opposite sides of said security cover when said security cover is engaged with said second housing over said opening wherein said member extends past said cover in order to engage and unlatch said latching assembly and wherein said locking mechanism locks said security cover over said opening.

2. The currency acceptor unit in claim 1 including a passage defined through said security cover and aligned with said latching assembly when said cover is positioned over said opening wherein said member includes a plunger which passes through said passage in said security cover in order to retain said security cover over said opening and which engages said latching assembly in order to unlatch said latching assembly when moved from a retracted to an extended position.

3. The currency acceptor unit in claim 2 wherein said plunger includes a handle penetrating said second housing for manual movement of said plunger to unlatch said latching assembly.

4. The currency acceptor unit in claim 3 including a plunger keeper which engages a portion of said plunger and thereby keeps said plunger in a retracted position whereby said plunger cannot unlatch said latching assembly, wherein said plunger keeper responds to said security cover engaging said second housing by disengaging said plunger in order to allow said plunger to unlatch said latching assembly.

5. The currency acceptor unit in claim 2 including a plunger keeper which engages a portion of said plunger and thereby keeps said plunger in a retracted position whereby said plunger cannot unlatch said latching assembly, wherein said plunger keeper responds to said security cover engaging said second housing by disengaging said plunger in order to allow said plunger to unlatch said latching assembly.

6. The currency acceptor unit in claim 4 including a plunger retraction blocking member which engages a portion of said plunger and thereby keeps said plunger in said extended position in order to prevent removal of said security cover from said opening.

7. The currency acceptor unit in claim 6 including a locking device which engages said plunger retraction blocking member in order to allow said plunger retraction blocking member to disengage said plunger in response to unlocking of said locking device whereby said security cover can be removed from said opening.

8. The currency acceptor unit in claim 7 including an access door in said second housing and a door latch for latching said door shut, wherein said locking device engages said door latch in order to allow said door to be opened in response to unlocking of said locking device whereby cash can be removed from said cash box.

9. The currency acceptor unit in claim 8 wherein said door latch in a bar on said door which engages said second housing at opposite sides of said door in order to latch said door shut.

10. The currency acceptor unit in claim 5 including a locking device which engages said plunger keeper in order to inhibit said plunger keeper from disengaging said plunger when said locking device is locked, wherein said locking device must be unlocked in order to remove said cash box from said currency acceptance and transport assembly.

11. The currency acceptor unit in claim 1 wherein said actuatable latching assembly includes a sliding latching member which selectively engages a pin on said second housing and a motion translator for translating motion perpendicular to the direction of movement of said latching member to motion in the direction of movement of said latching member.

12. A currency acceptor unit, comprising;

a currency acceptance and transport assembly having a first housing and an actuatable latching assembly on said first housing;

a cash box having a second housing and an opening in said second housing configured to interface with said first housing in a manner that said actuatable latching assembly retains said housings together, wherein currency may be passed through said opening from said currency acceptance and transport unit;

a security cover configured to engage said second housing over said opening;

a locking mechanism including a member which unlatches said latching assembly so that said cash box can be removed from said currency acceptance and transport assembly, wherein said locking mechanism locks said security cover over said opening, wherein said member includes a plunger which passes through said security cover in order to retain said security cover over said opening and which engages said latching assembly in order to unlatch said latching assembly when moved from a retracted to an extended position, wherein said plunger includes a handle penetrating said second housing for manual movement of said plunger to unlatch said latching assembly;

a plunger keeper which engages a portion of said plunger and thereby keeps said plunger in a retracted position whereby said plunger cannot unlatch said latching assembly, wherein said plunger keeper responds to said security cover engaging said second housing by disengaging said plunger in order to allow said plunger to unlatch said latching assembly;

a plunger retraction blocking member which engages a portion of said plunger and thereby keeps said plunger in said extended position in order to prevent removal of said security cover from said opening;

a locking device which engages said plunger retraction blocking member in order to allow said plunger retraction blocking member to disengage said plunger in response to unlocking of said locking device whereby said security cover can be removed from said opening; and another locking device which inhibits said locking device from engaging said plunger retraction blocking member when said another locking device is locked, whereby both locking devices must be unlocked to remove said security cover from said opening.

13. The currency acceptor unit in claim 12 wherein said another locking device engages said plunger keeper in order to inhibit said plunger keeper from disengaging said plunger when said another locking device is locked, wherein said another locking device must be unlocked in order to remove said cash box from said currency acceptance and transport assembly.

14. The currency acceptor unit in claim 12 including an access door in said second housing and a door latch for latching said door shut, wherein said locking device unlatches said door latch in order to allow said door to be opened when unlocked and wherein said another locking device inhibits said locking device from unlatching said door latch, whereby both locking devices must be unlocked to unlatch said door.

15. A currency acceptor unit, comprising:

a currency acceptance and transport assembly having a first housing and an actuatable latching assembly on said first housing, wherein said actuatable latching assembly includes a sliding latching member which selectively engages a pin on said second housing and a motion translator for translating motion perpendicular to the direction of movement of said latching member to motion in the direction of movement of said latching member;

a cash box having a second housing and an opening in said second housing configured to interface with said first housing in a manner that said actuatable latching assembly retains said housings together, wherein currency may be passed through said opening from said currency acceptance and transport unit;

a security cover configured to engage said second housing over said opening;

a locking mechanism including a member which unlatches said latching assembly so that said cash box can be removed from said currency acceptance and transport assembly, wherein said locking mechanism locks said security cover over said opening; and a switch responsive to said pin in order to signal the presence of said cash box.

16. A currency acceptor unit, comprising:

a currency acceptance and transport assembly having a first housing;

a cash box having a second housing and an opening in said second housing configured to interface with said first housing wherein currency may be passed through said opening from said currency acceptance and transport unit;

a security cover configured to engage said second housing over said opening;

an actuatable latching assembly on one of said housings and a pin engageable by said latching assembly on the other of said housings in order to selectively retain said cash box to said currency acceptance and transport assembly; and a locking mechanism which unlatches said latching assembly so that said cash box can be removed from said currency acceptance and transport assembly, wherein said locking mechanism includes a plunger that is reciprocable between a retracted position and an extended position in order to unlatch said latching assembly and a manual actuation lever configured to be grasped by a user for manual manipulation of said plunger from said retracted position to said extended position to unlatch said latching assembly.

17. The currency acceptor unit in claim 16 including a plunger keeper which keeps said plunger in said retracted position, said plunger keeper being responsive to said security cover being over said opening in order to withdraw said keeper from said plunger whereby said plunger can be manually manipulated to said extended position to unlatch said latching assembly only with the security cover over the opening.

18. The currency acceptor unit in claim 16 wherein said plunger retains said security cover over said opening when said plunger is in said extended position.

19. The currency acceptor unit in claim 18 wherein said locking mechanism further includes a plunger retraction block for blocking said plunger from retracting to said retracted position from said extended position in order to prevent removal of said security cover.

20. The currency acceptor unit in claim 17 including a lock device which prevents said plunger keeper from being withdrawn from said plunger when locked, whereby said cash box can be removed from said currency validation and transport assembly only by unlocking said lock device.

21. The currency acceptor unit in claim 16 wherein said latching assembly is on said first housing and wherein said plunger extends through a passage in said security plate when extended, wherein said plunger must extend through said passage prior to unlatching said latching assembly.

22. The currency acceptor unit in claim 21 wherein said actuatable latching assembly includes a sliding latching member which selectively engages a pin on said second housing and a motion translator for translating motion perpendicular to the direction of movement of said latching member to motion in the direction of movement of said latching member.

23. A currency acceptor unit, comprising;

a currency acceptance and transport assembly having a first housing;

a cash box having a second housing and an opening in said second housing configured to interface with said first housing wherein currency may be passed through said opening from said currency acceptance and transport unit;

a security cover configured to engage said second housing over said opening;

an actuatable latching assembly on one of said housings and a pin engageable by said latching assembly on the other of said housings in order to selectively retain said cash box to said currency acceptance and transport assembly; and a locking mechanism which unlatches said latching assembly so that said cash box can be removed from said currency acceptance and transport assembly, wherein said locking mechanism includes a plunger that is reciprocable between a retracted position and an extended position in order to unlatch said latching assembly and a manual lever for manual manipulation of said plunger, wherein said locking mechanism is mounted to a door in said second housing.

24. The currency acceptor unit in claim 23 further including a door latch for latching said door and a lock device which unlatches said door latch when unlocked.

25. The currency acceptor unit in claim 24 wherein said lock device further withdraws said blocking device from blocking said plunger when unlocked.

26. The currency acceptor unit in claim 24 wherein said door latch is a bar which engages said first housing at opposite sides of said door.

27. The currency acceptor unit in claim 24 including another lock device which prevents said plunger keeper from being withdrawn from said plunger when locked, whereby said cash box can be removed from said currency acceptance and transport assembly only by unlocking said another lock device.

28. The currency acceptor unit in claim 27 wherein said another lock inhibits said lock device from unlatching said door latch unless said another lock device is also unlocked.

29. A currency acceptor unit, comprising:

a currency acceptance and transport assembly having a first housing;

a cash box having a second housing and an opening in said second housing configured to interface with said first housing wherein currency may be passed through said opening from said currency acceptance and transport unit;

a security cover configured to engage said second housing over said opening;

an actuatable latching assembly on said first housing and a pin engageable by said latching assembly on said second housing in order to selectively retain said cash box to said currency acceptance and transport assembly, wherein said actuatble latching assembly includes a sliding latching member which selectively engages said pin and a motion translator for translating motion perpendicular to the direction of movement of said latching member to motion in the direction of movement of said latching member;

a locking mechanism which unlatched said latching assembly so that said cash box can be removed from said currency acceptance and transport assembly, wherein said locking mechanism includes a plunger that is reciprocally between a retracted position and an extended position in order to unlatch said latching assembly and a manual lever for manual manipulation of said plunger, wherein said latching assembly is on said first housing and wherein said plunger extends through a passage in said security cover when extended, wherein said plunger must extend through said passage prior to unlatching said latching assembly; and a switch responsive to said pin in order to signal the presence of said cash box.

30. A currency acceptor unit, comprising:

a currency acceptance and transport assembly having a first housing;

a cash box having a second housing and an opening in said second housing configured to interface with said first housing in a manner that currency may be passed through said opening from said currency acceptance and transport unit;

a security cover configured to engage said second housing over said opening; and a currency displacement assembly extending substantially the entire length of currency in said cash box in the direction of movement of said security cover being engaged with said second housing, said displacement assembly actuated by said security cover wherein substantially the entire surface of a stack of currency in said cash box is displaced away from said cover.

31. The currency acceptor unit in claim 30 wherein said currency displacement assembly includes a pair of moveable rails on opposite sides of said opening and said security cover includes camming surfaces on opposite sides thereof, wherein said movement of said security cover causes said camming surfaces to move said rails away from said cover to remove currency in said cash box from the path of movement of said cover.

32. The currency acceptor unit in claim 31 further including a currency depressor on one end of said opening wherein a leading edge of said security cover in the direction of said movement of said security cover actuates said currency depressor to displace a leading edge of said stack of currency away from said cover.

33. The currency acceptor unit in claim 31 wherein each of said moveable rails includes studs extending through said second housing and biased support members external of said second housing biasing said studs.

34. The currency acceptor unit in claim 33 including a cover for said biased support members.

35. The currency acceptor unit in claim 30 further including a currency depressor on one end of said opening wherein a leading edge of said security cover in the direction of said movement of said security cover actuates said currency depressor to displace a leading edge of said stack of currency away from said cover.

36. A lockable cash box for use with a currency acceptance and transport assembly having an actuatable latching assembly, comprising:

a housing and an opening in said housing configured to receive currency from a currency acceptable and transport assembly latched to said housing over said opening;

a security cover configured to engage said housing over said opening; and a security cover locking mechanism which includes a plunger that is reciprocable between a retracted position and an extended position and a manual actuation lever configured to be grasped by a user for manual manipulation of said plunger from said retracted position to said extended position, wherein said plunger actuates the actuatable latching assembly of the currency and acceptance transport assembly in said extended position.

37. The lockable cash box of claim 36 including a plunger keeper which keeps said plunger in said retracted position, said plunger keeper being responsive to said security cover being over said opening in order to withdraw said keeper from said plunger whereby said plunger can be manually manipulated to said extended position to unlatch said latching assembly only with the security cover over the opening.

38. The lockable cash box of claim 36 wherein said plunger retains said security cover over said opening when said plunger is in said extended position.

39. The lockable cash box of claim 38 wherein said locking mechanism further includes a plunger retraction block for blocking said plunger from retracting to said retracted position from said extended position in order to prevent removal of said security cover.

40. A lockable cash box for use with a currency acceptance and transport assembly having an actuatable latching assembly, comprising;

a housing and an opening in said housing configured to receive currency;

a security cover configured to engage said housing over said opening; and a security cover locking mechanism which includes a plunger that is reciprocable between a retracted position and an extended position and a manual lever for manual manipulation of said plunger wherein said locking mechanism is mounted to a door in said second housing.

41. The lockable cash box of claim 40 further including a door latch for latching said door and a lock device which unlatches said door latch when unlocked.

42. The lockable cash box of claim 41 wherein said lock device further withdraws said blocking device from blocking said plunger when unlocked.

43. The lockable cash box of claim 41 wherein said door latch is a bar which engages said first housing at opposite sides of said door.

44. The lockable cash box of claim 41 including another lock device which prevents said plunger keeper from being withdrawn from said plunger when locked, whereby said cash box can be removed from said currency validation and transport assembly only by unlocking said another lock device.

45. The lockable cash box of claim 44 wherein said another lock inhibits said lock device from unlatching said door latch unless said another lock device is also unlocked.

46. The lockable cash box of claim 37 including a lock device which prevents said plunger keeper from being withdrawn from said plunger when locked, whereby said cash box can be removed from said currency validation and transport assembly only by unlocking said lock device.

47. A lockable cash box for use with a currency acceptance and transport assembly, comprising:

a housing and an opening in said housing configured to receive currency;

a security cover configured to engage said housing over said opening; and a currency displacement assembly extending substantially the entire length of currency in said housing in the direction of movement of said security cover being engaged with said housing, said displacement assembly actuated by said security cover wherein substantially the entire surface of a stack of currency in said housing box is displaced away from said cover.

48. The lockable cash box in claim 47 wherein said currency displacement assembly includes a pair of moveable rails on opposite sides of said opening and said security cover includes camming surfaces on opposite sides thereof, wherein said movement of said security cover causes said camming surfaces to move said rails away from said cover to remove currency in said cash box from the path of movement of said cover.

49. The lockable cash box in claim 48 further including a currency depressor on one end of said opening wherein a leading edge of said security cover in the direction of said movement of said security cover actuates said currency depressor to displace a leading edge of said stack of currency away from said cover.

50. The lockable cash box in claim 48 wherein each of said moveable rails includes studs extending through said second housing and biased support members external of said second housing biasing said studs.

51. The lockable cash box in claim 50 including a cover for said biased support members.

52. The lockable cash box in claim 47 further including a currency depressor on one end of said opening wherein a leading edge of said security cover in the direction of said movement of said security cover actuates said currency depressor to displace a leading edge of said stack of currency away from said cover.

* * * * *

UNITED STATES PATENT AND TRADEMARK OFFICE

CERTIFICATE OF CORRECTION

PATENT NO. : 5,715,923
DATED : February 10, 1998
INVENTOR(S) : Donald A. Dekker, Lloyd D. Herring and Robert I. Courts It is certified that error appears in the above-identified patent and that said Letters Patent is hereby corrected as shown below:

Column 2, lines 16 and 17:
"requiting" should be --requiring--.

Column 9, line 22:
"pennanent" should be --permanent--.

Column 10, claim 12, line 49:
";" should be --:--.

Column 12, claim 23, line 60:
";" should be --:--.

Column 13, claim 29, line 49:
"actuatble" should be --actuatable--.

Column 13, claim 29, line 55:
"unlatched" should be --unlatches--.

Column 13, claim 29, line 59:
"reciprocally" should be --reciprocable--.

Column 15, claim 40, line 15:
";" should be --:--.

Signed and Sealed this

Twenty-fourth Day of August, 1999

*Attest:*

Q. TODD DICKINSON

*Attesting Officer*

*Acting Commissioner of Patents and Trademarks*